United States Patent [19]

Coonan

[11] 4,329,802

[45] May 18, 1982

[54] MAGAZINE FOR LARGE-CALIBER HANDGUNS

[75] Inventor: Daniel J. Coonan, St. Paul, Minn.

[73] Assignee: Coonan Arms, Inc., St. Paul, Minn.

[21] Appl. No.: 183,089

[22] Filed: Sep. 10, 1980

[51] Int. Cl.[3] ..... F41C 25/02

[52] U.S. Cl. ..... 42/50

[58] Field of Search ..... 42/50, 7, 18, 22

[56] References Cited

U.S. PATENT DOCUMENTS

| | | | |
|---|---|---|---|
| 273,448 | 3/1883 | Borchardt | 42/50 |
| 545,512 | 9/1895 | Lodetti | 42/50 |
| 1,299,303 | 4/1919 | Cowles | 42/50 |
| 1,323,063 | 11/1919 | Johnson et al. | 42/50 |
| 1,351,370 | 8/1920 | Chase | 42/7 |
| 2,427,304 | 9/1947 | Robbins | 42/50 |
| 2,441,735 | 5/1948 | Warner | 42/50 |
| 2,510,831 | 6/1950 | Patchett | 42/50 |
| 2,885,811 | 5/1959 | Womble, Jr. | 42/50 |
| 2,895,248 | 7/1959 | Sawin | 42/50 |
| 3,143,819 | 8/1964 | Stevens, Jr. | 42/50 |
| 3,453,762 | 7/1969 | Fremont | 42/50 |
| 3,726,038 | 4/1973 | Bredbury | 42/50 |
| 3,772,812 | 11/1973 | Day | 42/50 |

FOREIGN PATENT DOCUMENTS

| | | | |
|---|---|---|---|
| 406885 | 3/1934 | United Kingdom | 42/50 |

*Primary Examiner*—Charles T. Jordan

*Attorney, Agent, or Firm*—Merchant, Gould, Smith, Edell, Welter & Schmidt

[57] ABSTRACT

A magazine (20) for delivering rimmed cartridges to a handgun is disclosed. Magazine (20) includes a casing (22) having a removable base or closure (26). Magazine (20) further includes a spring loaded follower (51) for urging cartridges upwardly against solid lips (41, 42) and yieldable lips (4,5 46). Follower (51) cooperates with a latching mechanism comprised principally of a spring urged pawl (61) for engagement with a latch member (60). The latching mechanism disengages when magazine (20) is inserted into butt (21) of a handgun so that release (70) is cammed inwardly to force pawl (61) to disengage from latch member (60). The cartridges in magazine (20) assume a banana-shape with base support from a wedge (80).

20 Claims, 13 Drawing Figures

MAGAZINE FOR LARGE-CALIBER HANDGUNS

TECHNICAL FIELD

This invention relates to the field of weaponry, and particularly to a magazine for use with large caliber handguns to enable the automatic feed of a larger number of rimmed cartridges than has heretofore been possible.

BACKGROUND OF THE INVENTION

Handguns can be divided into two principal classes, revolvers and "automatics". In the former, cartridges are loaded singly into the chambers of a cylinder which rotates to bring successive cartridges into alignment with the barrel and firing mechanism. In the latter a magazine or clip containing a plurality of cartridges may be slid as a unit into the butt of the weapon allowing the cartridges to feed automatically into the firing chamber or breech. The fired cartridges are automatically extracted.

Cartridges are also of two types, rimmed and rimless. The latter effectively have a single diameter so they stack with parallel axes; the former have bases at first ends with rims of diameter greater than the rest of the cartridge. The present invention relates to automatic weapons using rimmed cartridges.

In the prior art, there are magazines for rimless cartridges of several calibers and for rimmed cartridges of small calibers. The magazines for rimless cartridges generally relate to rifles (see, e.g., U.S. Pat. No. 3,726,038). The magazines for pistols generally use rimmless cartridges. Magazines for rimmed cartridges are known to exist for .22 and .38 special handguns. U.S. Pat. Nos. 2,510,831 and 2,895,248 are exemplary of .22 caliber magazines. The former shows a spring urged platform plate for lifting two columns of cartridges upward in the magazine. The latter shows a spring urged follower for lifting a single column of cartridges. A guide element is movable among three positions in order to accomodate .22 short .22 long and .22 long rifle cartridges. The guide element is essentially a wedge extending along a narrow side from the bottom to the top of the magazine.

Magazines for .38 special and .22 caliber handguns have been sold commercially. The .38 special magazine is exemplary. It has a spring urged follower for moving cartridges upward. The magazine holds a maximum of five cartridges. The cartridges rest in a single banana-shaped column with the follower changing the angular orientation of the lower cartridge each time a bullet is fired. In this manner, the uppermost cartridge always maintains a proper orientation relative to the breech.

These prior art magazines are interesting, but have not taught how to make a magazine for a large caliber rimmed cartridge. Since a magazine for a handgun fits within the handle of the gun, geometry is an important aspect of any magazine design. Known magazines have not shown a combination of elements in a geometry usable in, for example, a .357 magnum. Furthermore, except for .22 caliber magazines, known magazines have not held more than five cartridges.

SUMMARY OF THE INVENTION

The present invention is directed to a magazine for cartridges for a handgun. The magazine includes a casing extending along a longitudinal axis between first and second ends. The casing has first and second broader sides and first and second narrower sides. The magazine also includes follower means for supporting a column of cartridges. The column has a top cartridge properly aligned for use in the handgun. The magazine further includes means for biasing the follower means substantially along the longitudinal axis toward the second end of the casing. In addition, the magazine includes means, when the magazine is fully loaded, for bearing at least one and less than all of the cartridges away from one of the first and second narrower sides. Finally, the magazine includes means for longitudinally holding a column of cartridges between the first and second ends.

In a preferred embodiment, the magazine includes a casing with a removable bottom closure. The broader sides of the casing include inwardly turned lips at the top one end of the casing. Additionally, inserts are welded or otherwise fastened to the broader sides. The inserts also extend above the open end of the casing and have inwardly turned lips. The inserts are made of spring steel resulting in yieldable lips.

The magazine includes an irregularly shaped, spring-loaded follower. The follower has an upper surface inclined properly so that as cartridges are stacked in a column above it, the last loaded cartridge is retained by the solid lips and by the yieldable lips in an alignment for proper use by the handgun. A spring for biasing the follower is compressed between the lower surface of the follower and the removable casing closure. The follower is bored for the insertion of a pivot pin. The pin extends into slots in the broader sides of the casing. The slots are inclined from the longitudinal axis of the casing so that as the follower is forced upward, it pivots about the pivot pin to constantly realign the first loaded cartridge while maintaining the last loaded cartridge in proper alignment for use in the handgun.

A triangular wedge is fastened to adjoin the closure and one of the narrower sides of the casing. The wedge supports the base of one or more of the cartridges when the magazine is fully loaded. For a .357 magazine, the wedge supports the bases of two cartridges. The wedge functions in cooperation with the follower to provide the necessary bottom support for the column of cartridges in order to hold the column in a usable configuration for large caliber, rimmed bullets.

The magazine also includes a latching mechanism for holding the follower in a position for easy cartridge loading with the feature of automatic release upon insertion of the magazine into the butt of the handgun. The latching mechanism includes a pawl rotatably attached in a recess of the follower. The pawl extends downwardly and is forced by a compression spring against a stop pin. The stop pin prevents the pawl from rotating into contact with the coil of the follower bias spring. The pawl includes a notch or catch at its lower end. The catch cooperates with a latch member extending above the bottom closure of the casing. A bevelled surface on the lower end of the pawl causes the descending pawl to pivot away from the latch member until the catch can be properly engaged by the latch member.

A release member is slideably retained along the closure of the casing. The release member extends beyond one of the narrower sides of the casing offering a bevelled end for camming engagement with an edge of the butt of the handgun when the magazine is inserted therein. At its other end, the release member has another bevelled surface for cooperation with the bevelled surface of the lower end of the pawl. Thus, upon movement caused by magazine insertion into the butt of the handgun, the release member forces the pawl to disengage from the catch member. The magazine is then ready to expel cartridges in cooperation with the various mechanisms of the handgun.

The present invention is particularly advantageous in that the various components cooperate to offer a geometry usable with more than five large caliber, rimmed cartridges. In particular, the upper surface of the follower cooperates with the wedge and the solid and yieldable lips to retain a column of cartridges in proper alignment for use in the handgun. The casing width and the ridges on the inside of the inserts cooperate to provide side support for the column of cartridges.

Another distinct advantage results from the novel latching mechanism including a release member which automatically releases the latching mechanism upon insertion of the magazine into the butt of the handgun.

Various other advantages and features of novelty characterizing the invention are pointed out with particularity in the claims annexed hereto and forming a part hereof. For a better understanding of the invention, its advantages, and objects obtained by its use, however, reference should be had to the drawing which forms a further part hereof, and to the accompanying descriptive matter, in which there is illustrated and described a preferred embodiment of the invention.

DETAILED DESCRIPTION OF THE INVENTION

Figure 1:
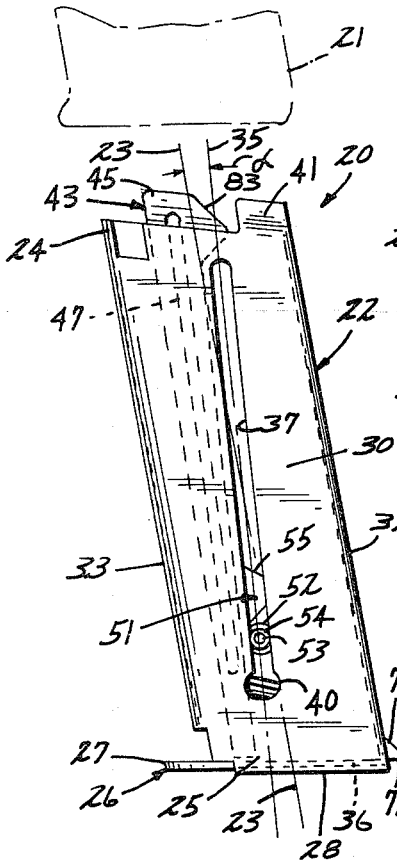
FIG. 1 is an elevational view of a magazine according to the invention, seen from one side.
Figure 2:
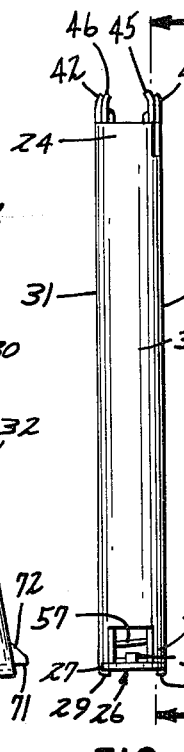
FIG. 2 is an edge elevational view of the magazine seen from the left in FIG. 1.
Figure 3:
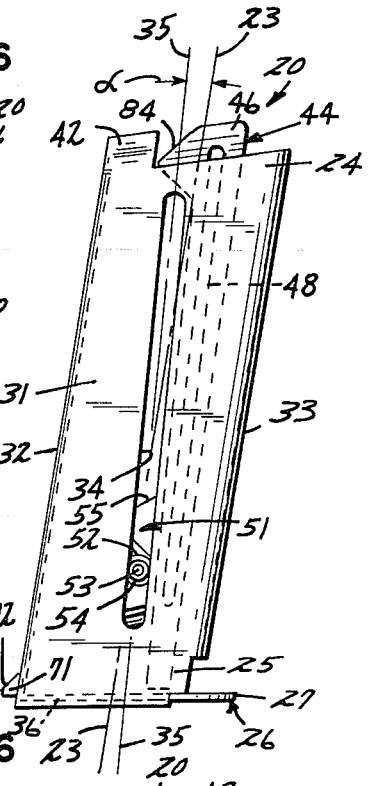
FIG. 3 is an elevational view of the opposite side of the magazine shown in FIG. 1.
Figure 4:
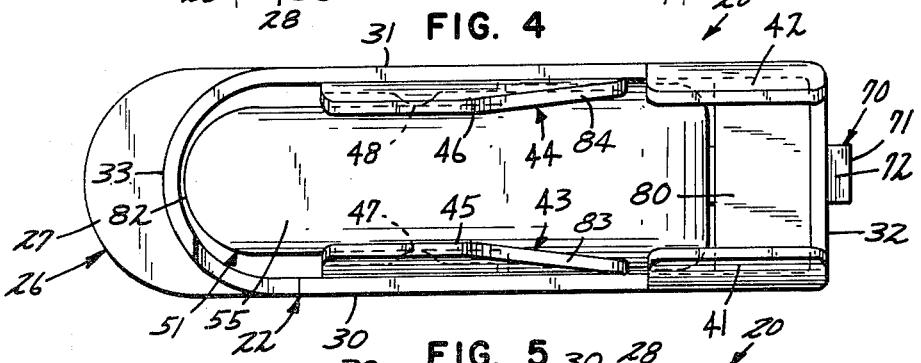
FIGS. 4 and 5 are end views of the magazine as seen from the top and bottom of FIG. 4 respectively, to a larger scale.
Figure 5:
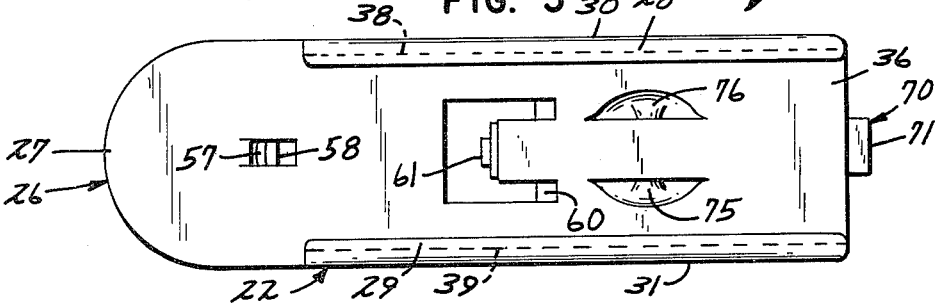

As suggested in FIG. 1, the invention comprises a magazine or clip 20 for sliding insertion into the butt 21 of a hand gun calibered for ammunition, such as rimmed .357 magnum cartridges.

In an embodiment in accordance with the present invention, as shown in FIGS. 1–5, magazine 20 comprises a casing 22 extending along a longitudinal axis 23 between an open upper end 24 and a lower end 25 having a slideably removable closure 26 with a portion 27 extending beyond the sides of casing 22. Casing 22 is of generally rectangular cross-section perpendicular to axis 23, with opposite broad sides 30 and 31 and opposite narrow sides 32 and 33. Broad sides 30 and 31 are flat. In the present embodiment narrow side 33 is semi-cylindrical while narrow side 32 is substantially flat. Other shapes are, however, equally applicable since casing sides must generally conform with the shape of the butt 21 of the particular hand gun used. Broad sides 30 and 31 include bottom lips 28 and 29 (see FIG. 5), inturned at approximately right angles from the planes of broad sides 30 and 31 for holding closure 26 in place. Closure 26 has notchs 38 and 39 along its side edges in order to slide between lips 28 and 29 at one end portion 36 and yet fit flush with the outer sides of broad sides 28 and 29 at the other end portion 27. End 36 is flush with the outer surface of narrow side 32 when the ends of notches 38 and 39 stop against the ends of bottom lips 28 and 29.

Side 31 has a longitudinal slot 34 along an axis 35 which is skewed at a small angle $\alpha$ with respect to axis 23. Side 30 has a similar slot 37 which is aligned with slot 34. The lower end of slot 37 has a circular enlargement 40 with function discussed hereinafter.

Broad sides 30 and 31 are extended at open end 24 near narrow side 32 and are slightly inturned to form solid lips 41 and 42. A pair of inserts 43 and 44 are secured by welding or other mechanism near the center of the inner surfaces of broad sides 30 and 31 respectively. Yieldable lips 45 and 46 are slightly inturned at the upper ends of inserts 43 and 44. Inserts 43 and 44 are made from spring steel and have inwardly formed ridges 47 and 48 extending longitudinally along their central portions. Lips 41, 42, 45, and 46 prevent movement of a cartridge out of the casing in a longitudinal direction along axis 23.

Figure 8:
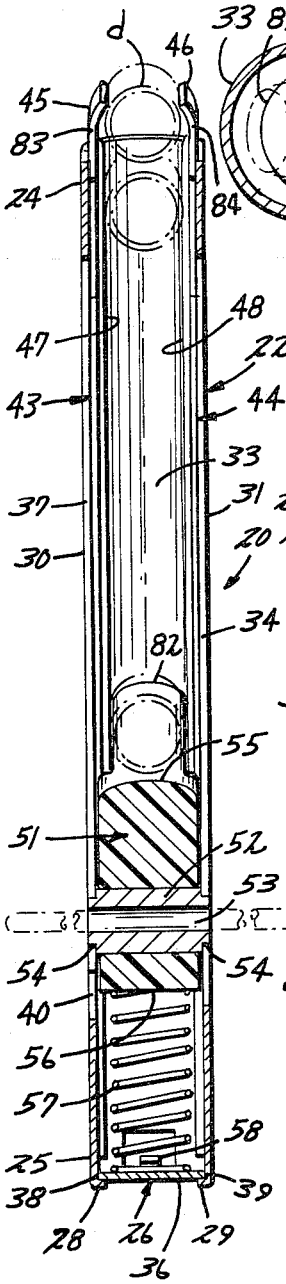
Figure 9:
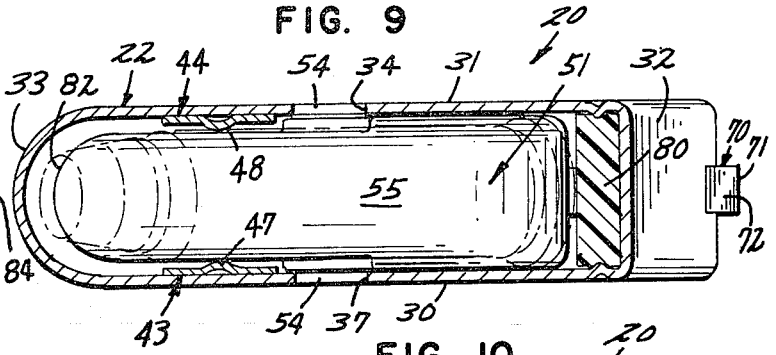
FIGS. 9 and 10 are transverse sectional views of the magazine generally along the lines indicated at 9—9 and 10—10 of FIG. 6.
Figure 10:
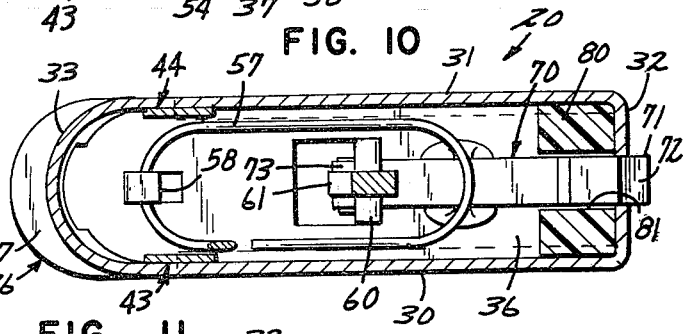

A follower 51 of irregular outline is located in casing 22 and is bored to receive a pivot pin 52 sized to pass through opening 40. Pivot pin 52 has a central aperture 53 and a pair of shoulders 54 (see FIG. 8) sized to slide in slots 34 and 37. Follower 51 has an upper surface 55 to engage the bottom cartridge in the magazine and a lower surface 56 to which is removably secured one end of a compression coil spring 57. The other end of spring 57 is removably secured to closure 26 by insertion under hook 58 extending upwardly from attachment with or formed in closure 26.

A latch member 60 is formed in or carried by closure 26. Latch member 60 has the general shape of an inverted L. A pawl 61 is pivoted in a recess 62 in follower 51 about a pin 63 and includes at its lower end a notch or a catch 64 for engagement with latch member 60 and a bevel surface 65 for interacting with bevel surface 73 of release 70 to be discussed hereinafter. Pawl 61 extends downwardly within the coils of spring 57. A small compression spring 66 acts against pawl 61 to urge it toward narrow side 32 against a stop pin 67, fastened to follower 51, thereby preventing pawl 61 from contacting spring 57. Spring 66 is retained in a cavity 59 in follower 51. When follower 51 moves downwardly with pin 52 sliding in slots 34 and 37, catch 64 at the lower end of pawl 61 engages latch member 60 to retain the follower in a "loading" position. The cartridges can then be inserted into casing 22 without having to overcome the force of spring 57.

Figure 7:
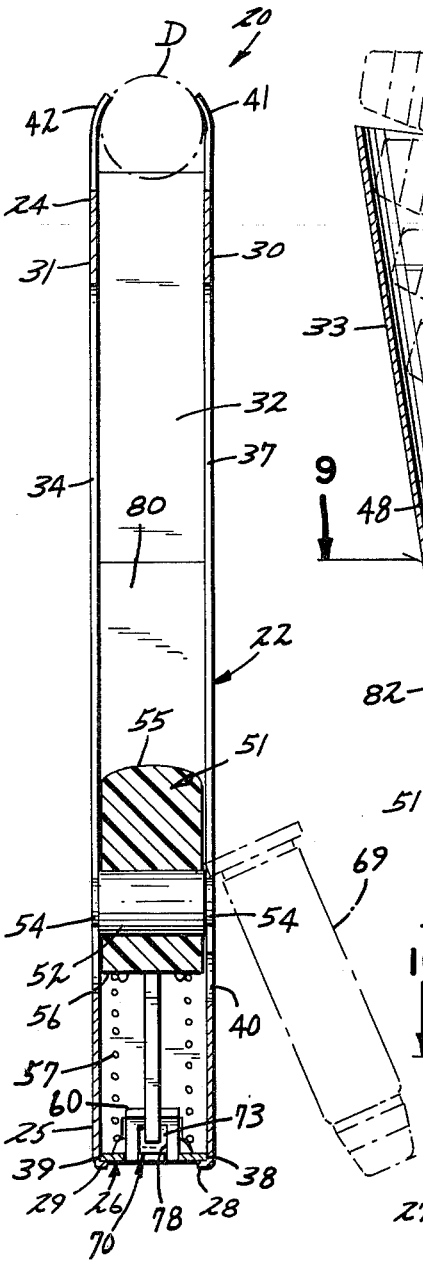
FIGS. 7 and 8 are generally longitudinal sectional views of the magazine taken along lines indicated at 7—7 and 8—8 in FIG. 6.

Movement of follower 51 into the loading position is accomplished either by using a simple tool such as a pin 68 passing through aperture 53 for engagement by the user's fingers (see FIG. 8) or by using the rim of a cartridge 69 to press against one of shoulders 54, as in FIG. 7.

Figure 12:
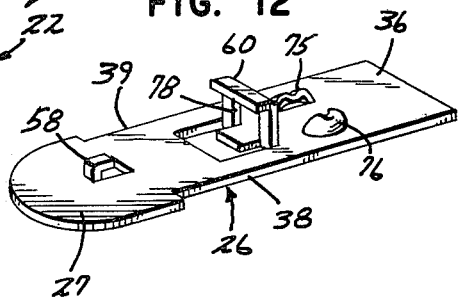
FIGS. 12 and 13 are perspective views showing details of individual components.
Figure 13:
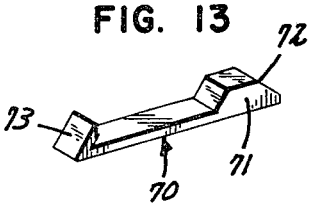

A release 70 is slideably mounted on the inner surface of closure 26 to project normally beyond narrow side 32 of casing 22 at an end 71 having a bevelled upper surface 72. The inner end of release 70 is also bevelled at 73 for camming engagement with the lower end of pawl 61. When magazine 20 is inserted into butt 21 of a handgun, surface 72 contacts an edge of butt 21 which cams release 70 inwardly. Movement of release 70 to the left in FIG. 6 or inwardly disengages pawl 61 from latch member 60 and releases follower 51. Sliding of release 70 is guided between bosses 75 and 76 in closure 26 (see FIGS. 6 and 12). At the same time release 70 moves under a turn of spring 57 held up by bosses 75 and 76. Sliding of release 70 is also guided by an opening 78 slightly wider than release 70, in the longitudinally-rising portion of latch member 60. Opening 78 is sufficiently long to allow removal of release 70.

Figure 6:
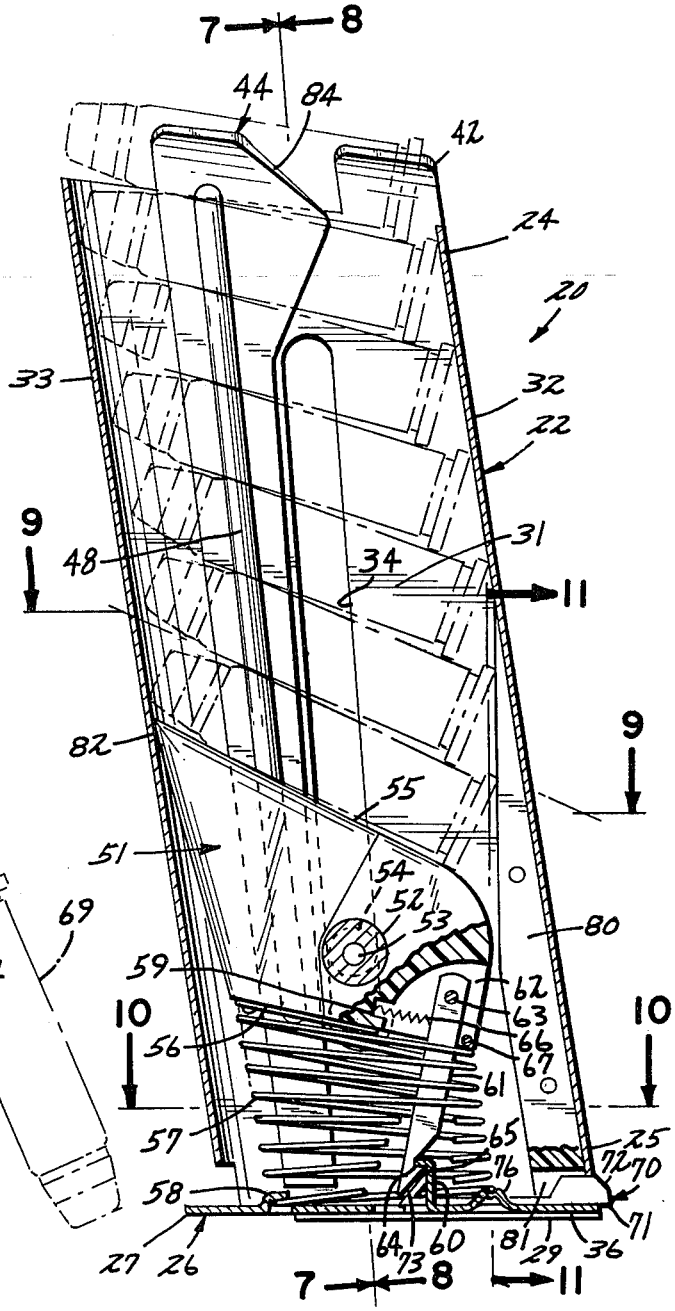
FIG. 6 is a sectional view along the line 6—6 of FIG. 2 with phantom lines showing stacked cartridges.
Figure 11:
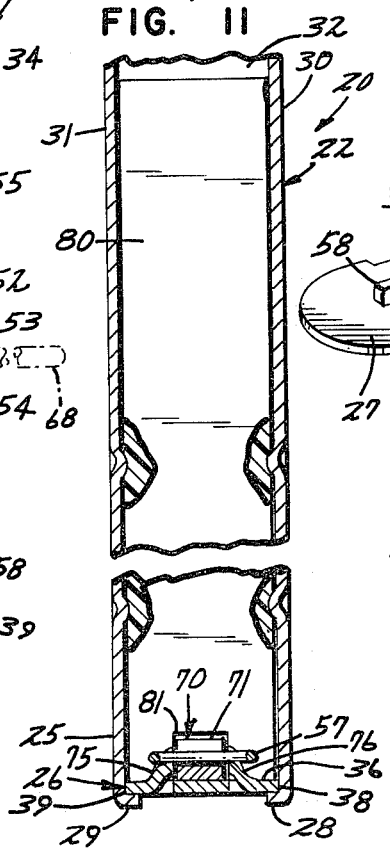
FIG. 11 is a fragmentary sectional view of the magazine generally along the line 11—11 of FIG. 6.

A wedge 80 is secured to the inner surface of the bottom portion of narrow side 32 and has a notch 81 (see FIG. 11) to permit passage of release 70. The purpose of wedge 80 and ridges 47 and 48 will now be apparent. The diameter D of the rim of a cartridge (see FIG. 7) is greater than the diameter d (see FIG. 8) of the body of the cartridge, so a casing thick enough to receive the rims leaves spaces for the load ends of the cartridges to shift from side to side. Ridges 47 and 48 are provided to retain the bodies of the cartridges in position. FIG. 6 shows in broken lines a set of cartridges in magazine 20, and makes it clear that the axes of the cartridges are not parallel because of the diameter difference mentioned above. Thus, the top surface 55 of follower 51 when the magazine is fully loaded is not parallel to the axis of the last cartridge loaded. Wedge 80 supports the base of the first loaded cartridge thereby stabilizing the column of cartridges.

It should be observed also that as follower 51 is forced upwards by spring 57, follower 51 rotates about pin 52 to the extent that an end 82 of surface 55 remains in contact with narrow side 33 of casing 22. The slight rotation of follower 51 repositions the first loaded cartridge so as to reorient the column of cartridges and keep the uppermost cartridge in a proper orientation for movement into the breech or barrel of the handgun.

OPERATION

Magazine 20 is removed from butt 21 of a handgun by conventional procedures forming no part of the invention. Follower 51 is retracted in magazine 20 by the use of a tool 68 as in FIG. 8 or with the aid of a cartridge 69 as in FIG. 7. Spring 66 holds pawl 61 against pin 67. As follower 51 and the parts attached to it descend, pawl 61 passes within the coils of spring 57. Spring 57 torgues end 82 of follower 51 against the inner surface of side 33, but as follower 51 descends, slots 34 and 37 come closer to side 32, and follower 51 rotates about pin 52. Bevel 65 engages latch 60 pivoting pawl 61 away from pin 67 to compress spring 66. When catch 64 passes latch 60, spring 66 moves pawl 61 about pivot 63 latching follower 51 in the loading position.

Cartridges may now be inserted into magazine 20. A cartridge is loaded base first between narrow side 33 and the upper edges of lips 45 and 46 nearermost barrel side 33. As a cartridge passes between the indicated parts, it is manipulated by the user's fingers into an approximately parallel orientation relative to the top edges of magazine 20. The cartridge is then dropped allowing it to settle on surface 55 of follower 51. The base of the first lowered cartridge is supported by wedge 80. The nose of the first loaded cartridge touches or very nearly touches narrower side 33 of casing 22. Subsequent cartridges are supported at the bases either by wedge 80 or narrower side 32. The rim of each subsequently loaded cartridge rests on the body diameter of a previously loaded cartridge while the body of the subsequently loaded cartridge rests at a contact point on the body of the previously loaded cartridge, the contact point being forwardly of the bases of the cartridges. In this fashion, each subsequently loaded cartridge assumes a slightly different orientation from the previously loaded cartridge. The column of cartridges assumes a bananashape. The cartridges are supported in the lateral dimension by a relatively close fit between the rims and broader sides 30 and 31 of casing 22. Forwardly of the bases, the bodies of the cartridges are supported by ridges 47, 48 of inserts 43, 44. It is preferable to avoid dimensions on casing 22 which would require a tight fit of any of the cartridges in a column. With a loose fit, frictional forces are minimized, and spring 57 and follower 51 are allowed to function and position the cartridges more properly. The preferred dimensions for a magazine for a .357 magnum handgun allow a fully-loaded magazine 20 to contain 7 cartridges. For this type of magazine, the two first loaded cartridges have bases supported by wedge 80.

With magazine 20 fully loaded, it is inserted into butt 21 of a handgun. It is pressed into place for engagement with butt 21 in a conventional manner. During this process, bevelled surface 72 of release 70 is cammed by the edge of butt 21. Release 70 moves inwardly thereby allowing bevelled surface 73 of release 70 to push bevelled surface 65 of pawl 61 away from latch member 60. This causes catch 64 of pawl 61 to disengage from latch member 60. Spring 57 then forces follower 51 upwardly thereby forcing the last loaded cartridge to press against solid lips 41 and 42 and yieldable lips 45 and 46.

The last loaded cartridge is now in a proper orientation to be forced by the firing mechanism of the handgun into the breech. During this process, the last loaded cartridge is moved a short distance laterally in a direction substantially parallel with its axis. As the rim of the cartridge passes beyond solid lips 41 and 42, the rim of the cartridge contacts ramps 83, 84 formed as a part of the lips 41, 42 respectively, and the nose of the cartridge contacts a ramp thereby forcing the cartridge longitudinally upwardly causing yieldable lips 45 and 46 to separate and expel the cartridge from magazine 20. Inserts 43 and 44 having yieldable lips 45 and 46 are made of spring steel and function for a large number of cartridge expulsions. However, in a preferred embodment, inserts 43 and 44 are replaceable.

Closure 26 is removable from casing 22 in order to repair or replace any of the other magazine parts.

Although the foregoing description has set forth numerous characteristics and advantages of the invention, together with details of the structure and function, the novel features thereof are pointed out in the appended claims. As a consequence, it is to be understood that the disclosure is illustrative only and that any changes made in detail, especially in matters of shape, size, and arrangement of parts, are within the principle of the invention to the full extent indicated by the broad general meaning of the terms in which the appended claims are expressed.

I claim:

1. A magazine for cartridges for a handgun, comprising:

a casing extending along a longitudinal axis between first and second ends, said casing having first and second broader sides and first and second narrower sides;

follower means for supporting a column of cartridges, said column having a top cartridge properly aligned for use in said handgun;

means for biasing said follower means substantially along the longitudinal axis toward said second end of said casing;

means, when said magazine is fully loaded, for bearing at least one and less than all of said cartridges away from one of said first and second narrower sides; and means for longitudinally holding said column of cartridges between said first and second ends.

2. A magazine in accordance with claim 1 wherein said bearing means includes a structural member forming a substantially triangular perimeter bounded on two sides by one of said first and second narrower sides and by said first end of said casing.

3. A magazine in accordance with claim 1 wherein said bearing means includes a wedge.

4. A magazine in accordance with claim 1 wherein said holding means includes means for releasably retaining said top cartridge against longitudinal movement.

5. A magazine in accordance with claim 4 wherein said retaining means includes spring steel lips, said lips being laterally separable upon application of a longitudinal force greater than that applied by said biasing means.

6. A magazine in accordance with claim 1 wherein said holding means includes:

means for latching said follower means in a loading position near said second end of said casing; and means for automatically releasing said latching means during installation of said magazine in said handgun.

7. A magazine in accordance with claim 6 wherein said latching means includes a pawl carried by said follower means and a latch at said second end of said magazine for engaging said pawl.

8. A magazine in accordance with claim 6 wherein said casing forms an enclosure and wherein said releasing means includes a release member projecting beyond said enclosure, said release member having a bevelled end for camming contact with said handgun whereby said release member moves automatically to disengage said latching means.

9. A magazine for delivering rimmed cartridges to a handgun, comprising, in combination:

a casing extending along a longitudinal axis between open and closed ends, said casing forming an enclosure having first and second broader sides and first and second narrower sides, said open end being configured for admission of cartridges into said casing;

a pair of aligned slots in said broader sides;

a follower of irregular outline in said casing including pivot means extending outwardly into said slots for allowing said follower to pivot, said follower having a first surface apposed to said closed end and a second surface apposed to said open end, said follower for supporting a column of cartridges, said column having a top cartridge properly aligned for use in said handgun;

first resilient means, acting between said first surface of said follower and said closed end of said casing, for forcing said follower toward said open end, said forcing means moving said follower each time a cartridge is removed from said open end causing said follower to rotate about said pivot means so that the orientation of said first surface with respect to said axis is determined by the position of said follower along said axis so as to keep said top cartridge in proper alignment;

means for releasably retaining said top cartridge from longitudinal movement;

a wedge abutting said second narrower side and said closed end within said casing, said wedge for supporting at least one and less than all of said cartridges in said magazine when fully loaded;

a pawl carried by said follower;

second resilient means, acting between said follower and said pawl, for forcing said pawl toward said second narrower side;

latch means, attached to said closed end of said casing, for releasably engaging said pawl; and means for releasing said latch means during installation of said magazine in said handgun.

10. A magazine in accordance with claim 9 wherein said first resilient means includes a coil spring.

11. A magazine in accordance with claim 10 wherein said pawl extends into said coil spring and said magazine further includes stop means for preventing said pawl from moving under influence of said second resilient means into contact with said spring.

12. A magazine in accordance with claim 9 including means for removably closing said closed end of said casing.

13. A magazine in accordance with claim 12 wherein said closing means includes a flat plate retained between said first resilient means and a pair of bottom lips on said broader sides.

14. A magazine in accordance with claim 9 or 13 wherein said latch means includes an upwardly extending latch member formed in said closed end and a notch in said pawl for engagement by said latch member.

15. A magazine according to claim 9 wherein said releasing means includes a release member slideably retained near said closed end of said casing, said release member projecting beyond the enclosure of said casing, said release member having a bevelled end for camming contact with said handgun to force movement and automatic disengagement of said latch means with said pawl.

16. A magazine in accordance with claim 15 wherein said releasing means includes matching ramp surfaces on said pawl and said release member for camming said pawl and said release member between engaged and disengaged positions relative to said latch means.

17. A magazine in accordance with claim 9 wherein said retaining means includes a pair of inserts attached to said broader sides, said inserts having first ends apposed to said open end of said casing and second ends apposed to said closed end, said inserts being curved arcuately toward each other near said first ends to form lips.

18. A magazine in accordance with claim 17 wherein said inserts are fabricated from spring steel.

19. A magazine in accordance with claims 17 or 18 wherein each said insert includes a ridge extending longitudinally substantially between said first and second ends, said ridges for guiding said cartridges between said broader sides of said casing.

20. A magazine for delivering rimmed cartridges to a handgun, comprising, in combination:

a casing extending along a longitudinal axis between open and closed ends, said casing being of generally rectangular cross-section perpendicular to said axis, said casing forming an enclosure having first and second broader sides and first and second narrower sides, said open end being configured for admission of cartridges into said casing in only a first orientation in which the bases of said cartridges are toward said second narrower side, said closed end being a removable flat plate retained by a pair of lips on said broader sides, said plate including an integral, upwardly extending latch member, said latch member including an opening therein adjacent the plane of said plate;

a pair of aligned slots in said broader sides;

a follower of irregular outline in said casing including a pivot pin extending outwardly into said slots, said follower having a first surface apposed to said closed end and a second surface apposed to said open end, said follower for supporting a column of cartridges, said column having a top cartridge properly aligned for use in said handgun;

a first coil spring, acting between said first surface of said follower and said close end of said casing, for forcing said follower toward said open end, said first spring moving said follower each time a cartridge is removed from said open end causing said follower to rotate about said pivot pin whereby the orientation of said first surface with respect to said axis is determined by the position of said follower along said axis so as to keep said top cartridge in proper alignment;

a pair of spring steel inserts attached to said broader sides, said inserts having first ends apposed to said open end of said casing and second ends apposed to said closed end, said inserts being curved arcuately inwardly near said first ends to form lips for releasably retaining said top cartridge from longitudinal movement;

a wedge abutting said second narrower side and said closed end within said casing, said wedge for supporting at least one and less than all of said cartridges in said magazine when fully loaded;

a pawl pivotably attached to said follower near a first end, said pawl having a notch near a second end for engagement by said latch member;

a second coil spring, acting between said follower and said pawl, for forcing said pawl toward said second narrower side;

stop means for preventing said pawl from moving under the influence of said second spring into contact with said first spring; and a release member slideably retained near said closed end of said casing, said release member projecting beyond the enclosure of said casing and extending through said openings in said latch member, said release member having a bevelled first end for camming contact with said handgun to force movement and automatic disengagement of said latch member with said pawl, said pawl at said second end and said release member at a second end having matching ramp surfaces for camming said pawl and said release member between engaged and disengaged positions relative to said latch member.

* * * * *

UNITED STATES PATENT AND TRADEMARK OFFICE

CERTIFICATE OF CORRECTION

PATENT NO. : 4,329,802

DATED : May 18, 1982

INVENTOR(S) : Daniel J. Coonan

It is certified that error appears in the above-identified patent and that said Letters Patent are hereby corrected as shown below:

In the Abstract, line 6, "4,5" should be --45,--.

Signed and Sealed this

*Third* Day of *August 1982*

[SEAL]

*Attest:*

GERALD J. MOSSINGHOFF

*Attesting Officer*

*Commissioner of Patents and Trademarks*